US007411596B2

(12) United States Patent
Inada et al.

(10) Patent No.: US 7,411,596 B2
(45) Date of Patent: Aug. 12, 2008

(54) DRIVING CIRCUIT FOR COLOR IMAGE DISPLAY AND DISPLAY DEVICE PROVIDED WITH THE SAME

(75) Inventors: Ken Inada, Nerima-ku (JP); Taketoshi Nakano, Kawasaki (JP); Toshihiro Yanagi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 660 days.

(21) Appl. No.: 10/819,274

(22) Filed: Apr. 7, 2004

(65) Prior Publication Data

US 2004/0212632 A1 Oct. 28, 2004

(30) Foreign Application Priority Data

Apr. 24, 2003 (JP) ..... 2003-119397

(51) Int. Cl.
*G09G 5/10* (2006.01)

(52) U.S. Cl. ..... 345/690; 345/89; 345/87; 345/204; 345/98

(58) Field of Classification Search ..... 345/690, 345/89, 204, 76, 77, 81, 94, 87
See application file for complete search history.

(56) References Cited

U.S. PATENT DOCUMENTS

| | | | | |
|---|---|---|---|---|
| 5,512,837 | A * | 4/1996 | Ohnishi | 324/704 |
| 5,892,494 | A * | 4/1999 | Kimura et al. | 345/96 |
| 6,765,551 | B2 * | 7/2004 | Nakano et al. | 345/89 |
| 6,888,526 | B2 * | 5/2005 | Morita | 345/95 |
| 7,034,797 | B2 * | 4/2006 | Maki | 345/100 |
| 7,091,937 | B2 * | 8/2006 | Nakamura | 345/76 |
| 2001/0052897 | A1 * | 12/2001 | Nakano et al. | 345/204 |
| 2002/0145600 | A1 * | 10/2002 | Morita | 345/211 |
| 2003/0043132 | A1 * | 3/2003 | Nakamura | 345/204 |
| 2003/0071777 | A1 * | 4/2003 | Kokubun et al. | 345/98 |
| 2004/0212632 | A1 * | 10/2004 | Inada et al. | 345/690 |
| 2005/0168416 | A1 * | 8/2005 | Hashimoto et al. | 345/76 |
| 2005/0200584 | A1 * | 9/2005 | Kudo et al. | 345/89 |
| 2006/0022925 | A1 * | 2/2006 | Hara et al. | 345/89 |
| 2006/0132344 | A1 * | 6/2006 | Ishii et al. | 341/144 |

FOREIGN PATENT DOCUMENTS

| | | |
|---|---|---|
| JP | 5-19725 | 1/1993 |
| JP | 5-19725 A | 1/1993 |
| JP | 6-138851 | 5/1994 |
| JP | 2001-100711 | 4/2001 |

* cited by examiner

*Primary Examiner*—Amare Mengistu
*Assistant Examiner*—Sarvesh J Nadkarni
(74) *Attorney, Agent, or Firm*—Nixon & Vanderhye P.C.

(57) ABSTRACT

In a gradation voltage generation circuit used in a video signal line driving circuit for driving video signal lines of a liquid crystal display device by time division based on switching control signals, a first variable resistor circuit is connected between one terminal of a voltage divider circuit for generating a gradation voltage group and a power source line for supplying a high-level voltage, and a second variable resistor circuit is connected between the other terminal of the voltage divider circuit and a power source line for supplying a low-level voltage. The resistances of the variable resistor circuits are switched based on the switching control signal. Thus, in the periods in which the video signal lines respectively connected to R, G and B pixel formation portions are driven, gradation voltages that are adapted to the gradation reproducibility for R, G and B are outputted respectively.

8 Claims, 7 Drawing Sheets

ONE HORIZONTAL SCANNING PERIOD

G1

G2

G3

LS

Gr

Gg

Gb

S1
r11 g11 b11 r21 g21 b21 r31 g31 b31

S2
r12 g12 b12 r22 g22 b22 r32 g32 b32

S3
r13 g13 b13 r23 g23 b23 r33 g33 b33

Vk
(k=0~63)
Vrk Vgk Vbk Vrk Vgk Vbk Vrk Vgk Vbk
TIME

DRIVING CIRCUIT FOR COLOR IMAGE DISPLAY AND DISPLAY DEVICE PROVIDED WITH THE SAME

CROSS REFERENCE TO RELATED APPLICATIONS

This application claims priority under 35 U.S.C. § 119(a) upon Japanese Patent Application No.2003-119397 titled "DRIVING CIRCUIT FOR COLOR IMAGE DISPLAY AND DISPLAY DEVICE PROVIDED WITH THE SAME," filed on Apr. 24, 2003, the content of which is hereby incorporated by reference.

BACKGROUND OF THE INVENTION

1. Field of the Invention

The present invention relates to display devices for displaying color images, and more specifically to display devices that generate a gradation voltage group made of voltages representing the gradations of an image, and that displays color images using a voltage that is selected from this gradation voltage group in accordance with an input signal, as well as driving circuits of such display devices.

2. Description of the Related Art

Liquid crystal display devices, for example, are provided with a gradation voltage generation circuit generating voltages representing the gradations in order to perform a gradation display. One of the plurality of voltages generated by this gradation voltage generation circuit is selected in accordance with an input signal, and an image of intermediate gradations is displayed by applying the selected voltage as the driving signal to the liquid crystal panel.

As described for example in JP 2002-82645A (the content of the corresponding U.S. 2001/0052897A1 is hereby incorporated by reference), a gradation voltage generation circuit for such gradation display is typically incorporated in a video signal line driving circuit (referred to as "column electrode driving circuit") for driving the liquid crystal panel, and is realized as a voltage divider circuit that is a resistor series made of a plurality of resistors connected in series. The gradation voltages depend on the voltage division ratios of this voltage divider circuit, and it is important to set the voltage division ratios with consideration to the display quality.

A color filter that is used for the color image display with a liquid crystal display device is typically made of filters of the three colors R (red), G (green) and B (blue) constituting three primary colors, but as shown in FIG. 9, the gradation level—brightness curve is slightly different for each of these three colors. This means, that the gradation reproducibility of the pixel formation portions constituting the liquid crystal panel is different for each of the three colors. In FIG. 9, the horizontal axis marks the gradation levels of the colors R, G and B represented by the input signal, and the vertical axis marks the brightness of the colors R, G and B on the liquid crystal panel. It should be noted that the brightness on the vertical axis is normalized by its maximum value.

Thus, the gradation level—brightness curves are slightly different for each of the colors R, G and B, but in conventional liquid crystal display devices, the gradation voltage generation circuit is provided with only one resistor series, or two resistor series for positive polarity and negative polarity (in the following, it is assumed for convenience's sake that there is only one resistor series, even if a resistor series for positive polarity and a resistor series for negative polarity are provided). Therefore, it was not possible to set the gradation voltages (or voltage division ratios) individually in accordance with the gradation level—brightness curve for each of the colors R, G and B. As a result, it was not possible to maintain a superior color balance across the entire brightness region, and a high degree of color reproducibility could not be attained. Moreover, in ordinary liquid crystal display devices, if three resistor series corresponding to the gradation level—brightness curves of the colors R, G and B are provided, then three times the number of voltage bus lines for transmitting the gradation voltages are necessary (gradation number×3), and the chip area of the IC (integrated circuit) for realizing the video signal line driving circuit increases considerably.

SUMMARY OF THE INVENTION

It is thus an object of the present invention to provide a display device with which the color reproducibility can be enhanced by using gradation voltages that are adapted to the gradation level—brightness curves (gradation reproducibility) of each of the three primary colors while preventing an increase of the chip area of the IC for realizing the driving circuit, as well as such a display device driving circuit.

According to one aspect of the present invention, a color image display driving circuit for generating a plurality of voltage signals to be applied to a plurality of pixel formation portions, based on input signals including a first, a second and a third color image signal that respectively represent gradations of a first, a second and a third color constituting three primary colors, comprises:

a gradation voltage generation circuit for outputting a gradation voltage group made of a plurality of voltages that represent different gradations;

a plurality of selection circuits, each selection circuit being for selecting one of the plurality of voltages in the gradation voltage group in accordance with the input signals; and an output circuit for outputting the plurality of voltages selected by the plurality of selection circuits respectively as the plurality of voltage signals;

wherein the plurality of selection circuits successively switch between a first period in which the voltage is selected in accordance with the first color image signal, a second period in which the voltage is selected in accordance with the second color image signal, and a third period in which the voltage is selected in accordance with the third color image signal; and wherein the gradation voltage generation circuit changes a portion of or all voltages constituting the gradation voltage group in response to the switching between the first period, the second period and the third period, and in accordance with the differences between the first color, the second color and the third color in gradation reproducibility of the plurality of pixel formation portions.

With this configuration, successive switches are made between a first period in which the voltage is selected in accordance with the first color image signal, a second period in which the voltage is selected in accordance with the second color image signal, and a third period in which the voltage is selected in accordance with the third color image signal, and a portion of or all voltages constituting the gradation voltage group is/are changed in response to the switching between these periods, and in accordance with the differences between the first to third colors in gradation reproducibility of the plurality of pixel formation portions. Thus, it is possible to display color images using gradation voltages adapted to the respective gradation reproducibilities of the three primary colors without increasing the number of voltage bus lines for transmitting the gradation voltage group to the plurality of selection circuits.

In this driving circuit, it may be that the gradation voltage generation circuit comprises:

a first voltage divider circuit for generating a plurality of voltages representing the different gradations of the first color;

a second voltage divider circuit for generating a plurality of voltages representing the different gradations of the second color;

a third voltage divider circuit for generating a plurality of voltages representing the different gradations of the third color; and a selector circuit for selecting the plurality of voltages generated by the first voltage divider circuit in the first period, the plurality of voltages generated by the second voltage divider circuit in the second period, and the plurality of voltages generated by the third voltage divider circuit in the third period;

wherein the plurality of voltages selected by the selector circuit are outputted as the gradation voltage group.

With this configuration, the gradation voltage generation circuit comprises first to third voltage divider circuits corresponding to the first to third colors, and the voltage group generated by the first voltage divider circuit is outputted as the gradation voltage group in the first period, the voltage group generated by the second voltage divider circuit is outputted as the gradation voltage group in the second period, and the voltage group generated by the third voltage divider circuit is outputted as the gradation voltage group in the third period. Thus, the voltages of the outputted gradation voltage group can be changed in response to the switching between the first period, the second period and the third period, and in accordance with the differences between the first to third colors in gradation reproducibility at the plurality of pixel formation portions.

Moreover, in this driving circuit, it may be that the gradation voltage generation circuit comprises:

a voltage divider circuit for generating a plurality of voltages;

a first variable resistor circuit connected to one side of the voltage divider circuit; and a second variable resistor circuit connected to the other side of the voltage divider circuit;

wherein the first variable resistor circuit comprises a first selector switch for switching the resistance of the first variable resistor circuit such that the resistance of the first variable resistor circuit takes on a preset first value corresponding to the first color in the first period, a preset second value corresponding to the second color in the second period, and a preset third value corresponding to the third color in the third period;

wherein the second variable resistor circuit comprises a second selector switch for switching the resistance of the second variable resistor circuit such that the resistance of the second variable resistor circuit takes on a preset fourth value corresponding to the first color in the first period, a preset fifth value corresponding to the second color in the second period, and a preset sixth value corresponding to the third color in the third period; and wherein the gradation voltage generation circuit outputs the plurality of voltages generated by the voltage divider circuit as the gradation voltage group.

With this configuration, the resistances of the first and second variable resistor circuits that are respectively connected to the two terminals of the voltage divider circuit for generating the gradation voltage group in the gradation voltage generation circuit correspond to the first color in the first period, correspond to the second color in the second period, and correspond to the third color in the third period. Thus, the voltages of the outputted gradation voltage group can be changed in response to the switching between the first period, the second period and the third period, and in accordance with the differences between the first to third colors in gradation reproducibility at the plurality of pixel formation portions.

According to another aspect of the present invention, a display device comprises:

a color image display driving circuit for generating a plurality of voltage signals to be applied to a plurality of pixel formation portions, based on input signals including a first, a second and a third color image signal that respectively represent gradations of a first, a second and a third color constituting three primary colors;

a gradation voltage generation circuit for outputting a gradation voltage group made of a plurality of voltages that represent different gradations;

a plurality of selection circuits, each selection circuit being for selecting one of the plurality of voltages in the gradation voltage group in accordance with the input signals; and an output circuit for outputting the plurality of voltages selected by the plurality of selection circuits respectively as the plurality of voltage signals;

wherein the plurality of selection circuits successively switch between a first period in which the voltage is selected in accordance with the first color image signal, a second period in which the voltage is selected in accordance with the second color image signal, and a third period in which the voltage is selected in accordance with the third color image signal; and wherein the gradation voltage generation circuit changes a portion of or all voltages constituting the gradation voltage group in response to the switching between the first period, the second period and the third period, and in accordance with the differences between the first color, the second color and the third color in gradation reproducibility of the plurality of pixel formation portions.

It may be that this display device further comprises:

a plurality of video signal lines for transmitting the plurality of voltage signals to the plurality of pixel formation portions; and a connection switching circuit for connecting the output circuit and the plurality of video signal lines such that each of the plurality of voltage signals is applied to one of the plurality of video signal lines, and for switching the video signal lines to which the voltage signals are applied within predetermined video signal line groups;

wherein the output circuit comprises a plurality of output terminals respectively corresponding to a plurality of video signal lines groups obtained by grouping the plurality of video signal lines into a plurality of groups of three video signal lines made of video signal lines for a first, a second and a third color for respectively transmitting voltage signals to the pixel formation portions of a first, second and third color in the plurality of pixel formation portions; and wherein the connection switching circuit connects each output terminal of the output circuit to the video signal line for the first color of the three corresponding video signal lines in the first period, connects each output terminal of the output circuit to the video signal line for the second color of the three corresponding video signal lines in the second period, and connects each output terminal of the output circuit to the video signal line for the third color of the three corresponding video signal lines in the third period.

With this configuration, the output terminals of the output circuit are connected by time division to the video signal lines for the first, the second and the third color, which are the corresponding three video signal lines, and the video signal lines are driven by time division. Then, the voltages of the gradation voltage group are changed in response to the time division driving of the video signal lines, and in accordance with the differences between the first to third colors in gradation reproducibility of the plurality of pixel formation portions. Thus, it is possible to display color images using gradation voltages adapted to the respective gradation reproducibilities of the three primary colors without increasing the number of voltage bus lines for transmitting the gradation voltage group to the plurality of selection circuits.

It is preferable that this display device further comprises:

a plurality of scanning signal lines intersecting with the plurality of video signal lines; and a scanning signal line driving circuit for selectively driving the plurality of scanning signal lines;

wherein the plurality of pixel formation portions are arranged in a matrix, in correspondence with the intersections between the plurality of video signal lines and the plurality of scanning signal lines;

wherein each of the pixel formation portions comprises:

a switching element that is turned on and off by a scanning signal line passing through the corresponding intersection;

a pixel electrode that is connected via the switching element to the video signal line passing through the corresponding intersection; and a common electrode that is shared by the plurality of pixel formation portions, and that is arranged such that a predetermined capacitance is formed between that common electrode and the pixel electrode;

wherein the plurality of selection circuits switch between the first period, the second period and the third period, such that a period from a time at which one scanning signal line is selected by the scanning signal line driving circuit to a time when the next scanning signal line is selected is divided into the first, the second and the third period.

With this configuration, the period from a time at which one scanning signal line is selected by the scanning signal line driving circuit to the time when the next scanning signal line is selected (one horizontal scanning period) is divided into a first, a second and a third period, and the voltages of the gradation voltage group are changed in response to the switching between the first to third periods, and in accordance with the differences between the first to third colors in gradation reproducibility of the plurality of pixel formation portions. Thus, it is possible to display color images using gradation voltages adapted to the respective gradation reproducibilities of the three primary colors without increasing the number of voltage bus lines for transmitting the gradation voltage group.

According to yet another aspect of the present invention, a color image display driving method generating a plurality of voltage signals to be applied to a plurality of pixel formation portions, based on input signals including a first, a second and a third color image signal that respectively represent gradations of a first, a second and a third color constituting three primary colors, comprises:

a gradation voltage generation step of outputting a gradation voltage group made of a plurality of voltages that represent different gradations;

selection steps of selecting one of the plurality of voltages in the gradation voltage group in accordance with the input signals; and an output step of outputting the plurality of voltages selected by executing the selection steps in parallel as the plurality of voltage signals;

wherein, in the selection steps, successive switches are made between a first period in which the voltage is selected in accordance with the first color image signal, a second period in which the voltage is selected in accordance with the second color image signal, and a third period in which the voltage is selected in accordance with the third color image signal; and wherein, in the gradation voltage generation step, a portion of or all voltages constituting the gradation voltage group is/are changed in response to the switching between the first period, the second period and the third period, and in accordance with the differences between the first color, the second color and the third color in gradation reproducibility of the plurality of pixel formation portions.

These and other objects, features, aspects and advantages of the present invention will become more apparent from the following detailed description of the present invention when taken in conjunction with the accompanying drawings.

DETAILED DESCRIPTION OF THE EMBODIMENTS

In recent years, liquid crystal panels using TFTs (thin film transistors) with high carrier mobility, such as LPS (low temperature polysilicon) TFTs and CGS (continuous grain silicon) TFTs, have come to be manufactured, with which the pixel capacitance can be sufficiently charged even with a short on time of the TFTs in the pixel formation portions. By providing selector switches in such liquid crystal panels, it is possible to drive a plurality of video signal lines in the liquid crystal panel with only one output of a video signal line driving circuit. Liquid crystal display devices with such a configuration are known from the related art. That is to say, active-matrix liquid crystal display devices have been proposed, in which the plurality of video signal lines are grouped into a plurality of groups of two or more video signal lines (for example three video signal lines corresponding to three adjacent R, G and B pixels), one output terminal of the video signal line driving circuit is assigned to the plurality of video signal lines constituting each group, and video signals are applied by time division to the video signal lines within each group during one horizontal scanning period of the image display (see for example JP H06-138851A).

In active-matrix liquid crystal display devices of this driving type (referred to in the following as "video signal line time division driving method"), one horizontal scanning period is divided into, for example, a period in which the video signal lines corresponding to the R pixels are driven, a period in which the video signal lines corresponding to the G pixels are driven, and a period in which the video signal lines corresponding to the B pixels are driven, and it is possible to change (correct) the gradation voltages in each of these periods. That is to say, if video signal line time division driving method is employed, then it is possible to provide gradation voltages corresponding to gradation level—brightness curves (gradation reproducibility) for each of the colors R, G and B by changing the gradation voltages in response to a switching of the driving periods, without increasing the number of voltage bus lines for gradation voltage transmission, and thus, it becomes possible to enhance the color reproducibility of the color image display.

Referring to the accompanying drawings, the following is a description of a video signal line driving circuit of a liquid crystal display device in accordance with an embodiment of the present invention, which is based on this approach.

1.1 Overall Configuration and Operation

Figure 1A:
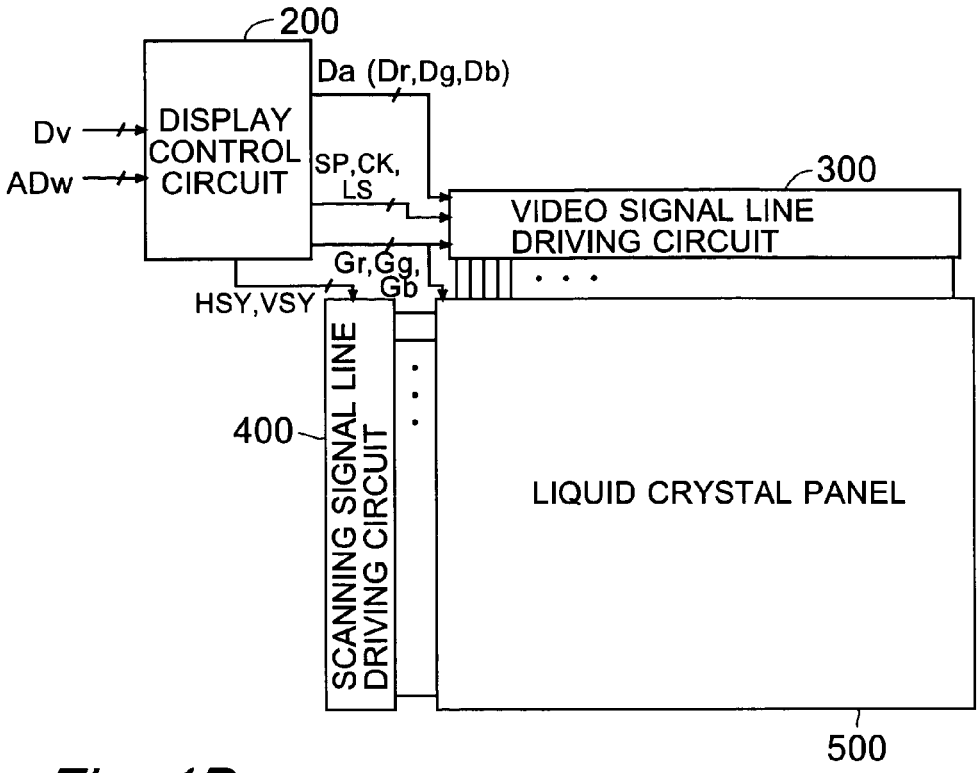
FIG. 1A is a block diagram showing the configuration of a liquid crystal display device provided with a video signal line driving circuit according to an embodiment of the present invention.

FIG. 1A is a block diagram showing the configuration of a liquid crystal display device provided with a video signal line driving circuit for color image display according to one embodiment of the present invention. This liquid crystal display device includes a display control circuit 200, a video signal line driving circuit 300 (also referred to as "column electrode driving circuit"), a scanning signal line driving circuit 400 (also referred to as "row electrode driving circuit"), and an active-matrix liquid crystal panel 500.

The liquid crystal panel 500 serving as the display portion in this liquid crystal display device comprises a plurality of scanning signal lines (row electrodes), which respectively correspond to the horizontal scanning lines in an image represented by image data Dv received from a CPU of an external computer or the like, a plurality of video signal lines (column electrodes) intersecting with the plurality of scanning signal lines, and a plurality of pixel formation portions that are provided in correspondence to the intersections of the plurality of scanning signal lines and the plurality of video signal lines. The configuration of these pixel formation portions is in principle the same as the configuration of the pixel formation portions in conventional active-matrix liquid crystal panels (details are discussed below).

In this embodiment, image data (in a narrow sense) representing an image to be displayed on the liquid crystal panel 500 and data determining the timing of the display operation (for example data indicating the frequency of the display clock) (referred to as "display control data" in the following) are sent from the CPU of the external computer or the like to the display control circuit 200 (in the following, the data Dv sent from the outside are referred to as "image data in a broad sense"). That is to say, the external CPU or the like writes the image data (in the narrow sense) and the display control data, which constitute the image data Dv in a broad sense, into a display memory and a register (described later) in the display control circuit 200 respectively while supplying address signals to the display control circuit 200.

Based on the display control data written into the register, the display control circuit 200 generates a display clock signal CK, a horizontal synchronization signal HSY, a vertical synchronization signal VSY, a start pulse signal SP and a latch strobe signal LS. Moreover, the display control circuit 200 reads out the image data that have been written into the display memory by the external CPU or the like, and outputs them as digital image signals Da. These digital image signals Da are made of three types of digital image signals, namely a image signal Dr representing the red gradation, an image signal Dg representing the green gradation, and an image signal Db representing the blue gradation, and these digital image signals Dr, Dg and Db are outputted by time division, as explained below. Here, the digital image signal Dr represents the red component of the image to be displayed (and is referred to below as "red image signal"), the digital image signal Dg represents the green component of the image to be displayed (and is referred to below as "green image signal"), and the digital image signal Db represents the blue component of the image to be displayed (and is referred to below as "blue image signal"). The display control circuit 200 also generates switching control signals Gr, Gg and Gb for time division driving of the video signal lines. Thus, of the signals generated by the display control circuit 200, the clock signal CK, the start pulse signal SP, the latch strobe signal LS and the digital image signal Da are supplied to the video signal line driving circuit 300, the horizontal synchronization signal HSY and the vertical synchronization signal VSY are supplied to the scanning signal line driving circuit 400, and the switching control signals Gr, Gg and Gb are supplied to the video signal line driving circuit 300 and to a later-described connection switching circuit within the liquid crystal panel 500. It should be noted that in the following explanations, the number of gradations of the image display is assumed to be 64, but the number of gradations is not limited to this. If the number of gradations is 64 as in the present embodiment, then the digital image signals Da are 6-bit signals.

As noted above, the data representing the image to be displayed on the liquid crystal panel 500 are supplied, pixel for pixel, as the digital image signals Da to the video signal line driving circuit 300, and the clock signal CK, the start pulse signal SP, the latch strobe signal LS and the switching control signals Gr, Gg and Gb are supplied to the video signal line driving circuit 300 as the signals indicating timing. Based on these signals Da, CK, SP, LS, Gr, Gg and Gb, the video signal line driving circuit 300 generates video signals for driving the liquid crystal panel 500 (referred to as "driving video signals" in the following), and applies these driving video signals to the video signal lines of the liquid crystal panel 500.

Figures 4A, 4B, 4C, 4D, 4E, 4F, 4G, 4H, 4I, 4J, 4K:
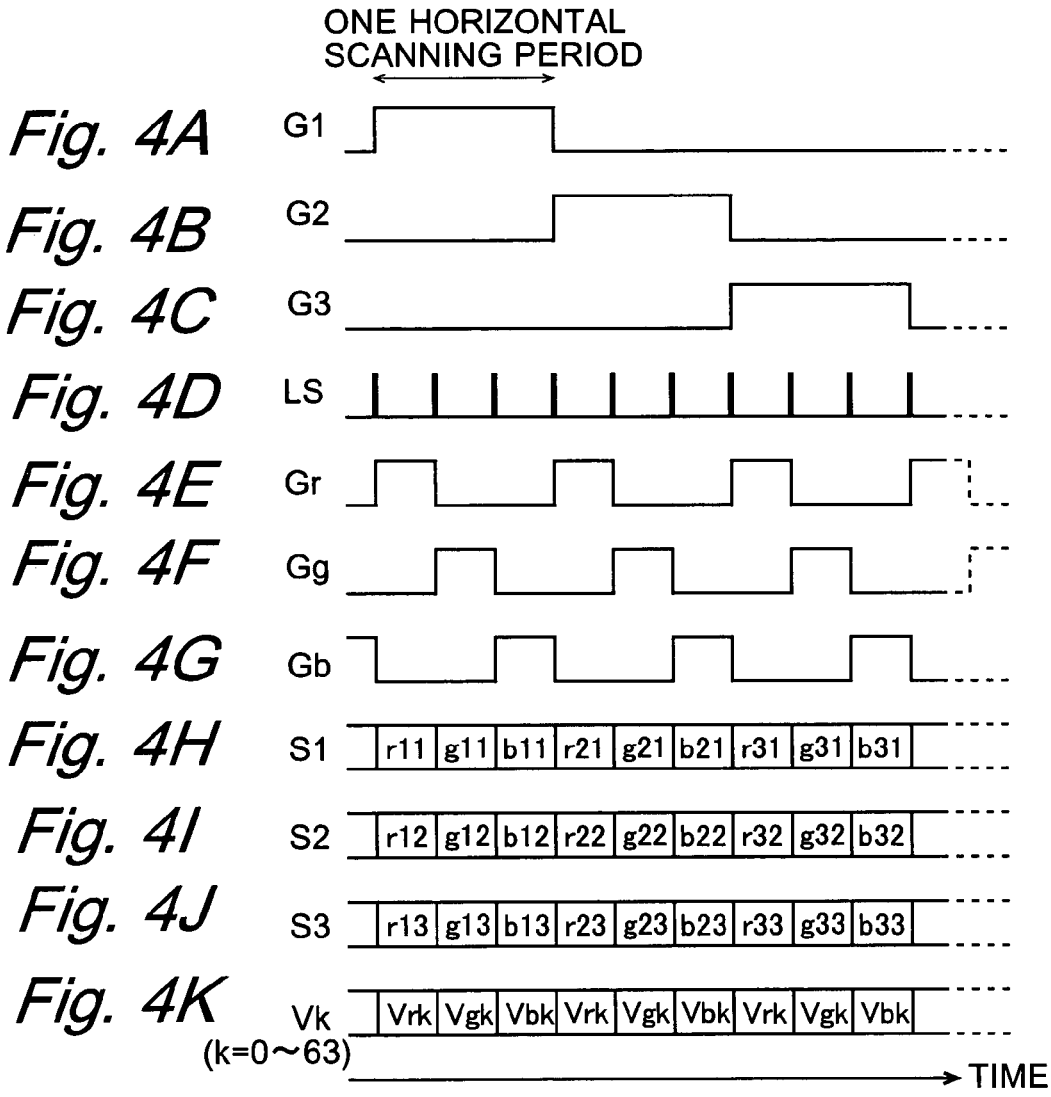
FIGS. 4A to 4K are timing charts illustrating a method for driving the liquid crystal display device provided with the video signal line driving circuit according to this embodiment.

Based on the horizontal synchronization signal HSY and the vertical synchronization signal VSY, the scanning signal line driving circuit 400 generates scanning signals G1, G2, G3, . . . to be applied to the scanning lines to successively select the scanning signal lines of the liquid crystal panel 500 in order for one horizontal scanning period each (see FIGS. 4A to 4C). The application of the active scanning signal to the scanning signal lines for successively selecting all of the scanning signal lines is carried out in repetition with a repeating period of one vertical scanning period.

As in the above-described manner, in the liquid crystal panel 500, the video signal line driving circuit 300 applies the driving video signals S1, S2, S3, . . . based on the digital image signals Da to the video signal lines, and the scanning signal line driving circuit 400 applies the scanning signals G1, G2, G3, . . . to the scanning signal lines. Thus, the liquid crystal panel 500 displays the color image represented by the image data Dv received from the external CPU or the like.

1.2 Display Control Circuit

Figure 1B:
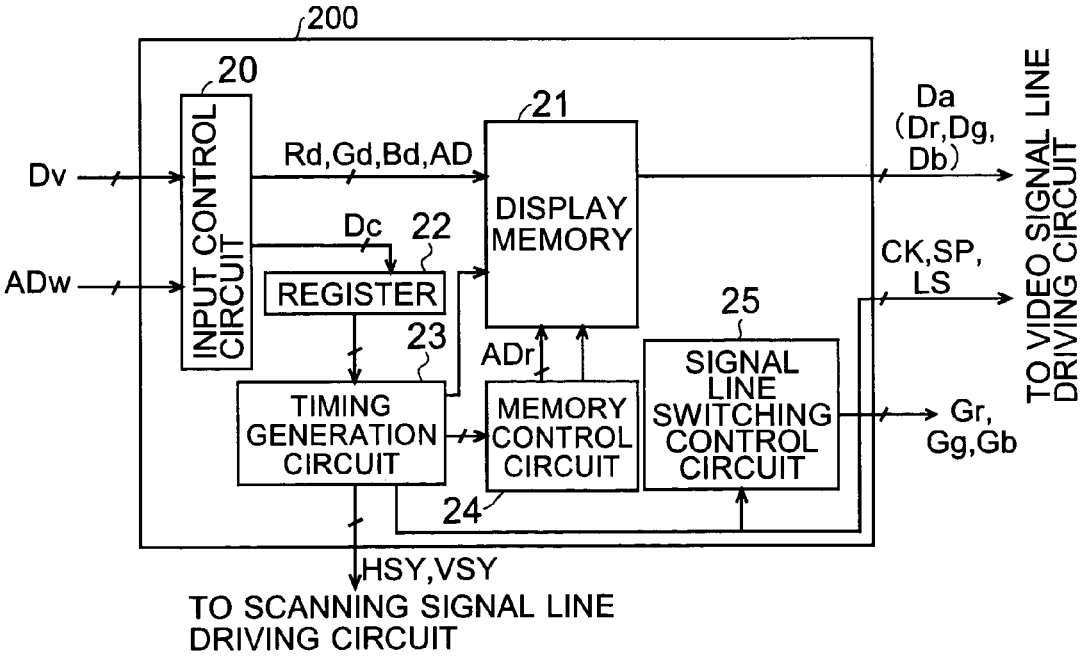
FIG. 1B is a block diagram showing the configuration of a display control circuit in the liquid crystal display device comprising the video signal line driving circuit according to this embodiment.

FIG. 1B is a block diagram showing the configuration of the display control circuit 200 in the above-described liquid crystal display device. This display control circuit 200 includes an input control circuit 20, a display memory 21, a register 22, a timing generation circuit 23, a memory control circuit 24, and a signal line switching control circuit 25.

Address signals ADw and signals representing image data Dv in a broad sense (in the following, also these signals are denoted as "Dv") that this display control circuit 200 receives from the external CPU or the like are inputted into the input control circuit 20. Based on the address signals ADw, the input control circuit 20 divides the image data Dv in a broad sense into three types of color image data Rd, Gd and Bd, and display control data Dc. Then, signals representing the color image data Rd, Gd and Bd (in the following, also these signals are denoted as "Rd," "Gd" and "Bd") are supplied to the display memory 21 together with address signals AD based on the address signals ADw, so that the three types of image data Rd, Gd and Bd are written into the display memory 21, and the display control data Dc are written into the register 22. Here, the three types of image data Rd, Gd and Bd are data that respectively represent red components, green components and blue components of the image represented by the image data Dv. The display control data Dc comprise timing information that specifies the frequency of the clock signal CK as well as the horizontal scanning period and the vertical scanning period for displaying the image represented by the image data Dv.

Based on the display control data held in the register 22, the timing generation circuit 23 generates the clock signal CK, the horizontal synchronization signal HSY, the vertical synchronization signal VSY, the start pulse signal SP and the latch strobe signal LS. In the present embodiment, the video signal lines are driven by time division, and the video signal lines to which the driving video signals from the output terminals of the video signal line driving circuit 300 are applied are switched every ⅓ of one horizontal scanning period (in the following referred to as "⅓ horizontal scanning period"). Accordingly, the pulse repetition period of the start pulse signal SP and the latch strobe signal LS supplied to the video signal line driving circuit 300 is also ⅓ horizontal scanning period. Moreover, the timing generation circuit 23 generates a timing signal for operating the display memory 21 and the memory control circuit 24 in synchronization with the clock signal CK.

Based on the horizontal synchronization signal HSY and the clock signal CK, the signal line switching control circuit 25 generates the switching control signals Gr, Gg and Gb for time division driving of the video signal lines. These switching control signals Gr, Gg and Gb are control signals for switching the video signal lines to which the driving video signals from the video signal line driving circuit 300 are to be applied within one horizontal scanning period. In the present embodiment, as shown in FIGS. 4E to 4G, a signal that is at H level (high level) only in a first period, namely the first ⅓ of each horizontal scanning period at which the scanning signal Gi (i=1, 2, 3, . . . ) is active, is generated as the first switching control signal Gr, a signal that is at H level only in a second period, namely the next ⅓ of each horizontal scanning period, is generated as the second switching control signal Gb, and a signal that is at H level only in a third period, namely the last ⅓ of each horizontal scanning period, is generated as the third switching control signal Gb. These switching control signals Gr, Gg and Gb are generated in synchronization with the latch strobe signal LS, as shown in FIGS. 4D to 4G.

The memory control circuit 24 generates address signals ADr for reading out, of the image data Rd, Gd and Bd that are inputted from outside and stored in the display memory 21, the data representing the image to be displayed on the liquid crystal panel 500. The memory control circuit 24 also generates a signal for controlling the operation of the display memory 21. The address signals ADr and the control signal are given into the display memory 21, and thus, the data representing the red component, the green component and the blue component of the image to be displayed on the liquid crystal panel 500 are read out by time division as the red image signal Dr, the green image signal Dg and the blue image signal Db from the display memory 21 respectively. That is to say, the image signals read out from the display memory 21 are switched at every ⅓ horizontal scanning period between the red image signal Dr, the green image signal Dg and the blue image signal Db in synchronization with the switching control signals Gr, Gg and Gb. Then, the three image signals Dr, Dg and Db that have been read out by time division in this manner are outputted as image signals Da from the display control circuit 200, and supplied to the video signal line driving circuit 300.

1.3. Liquid Crystal Panel

Figure 2A:
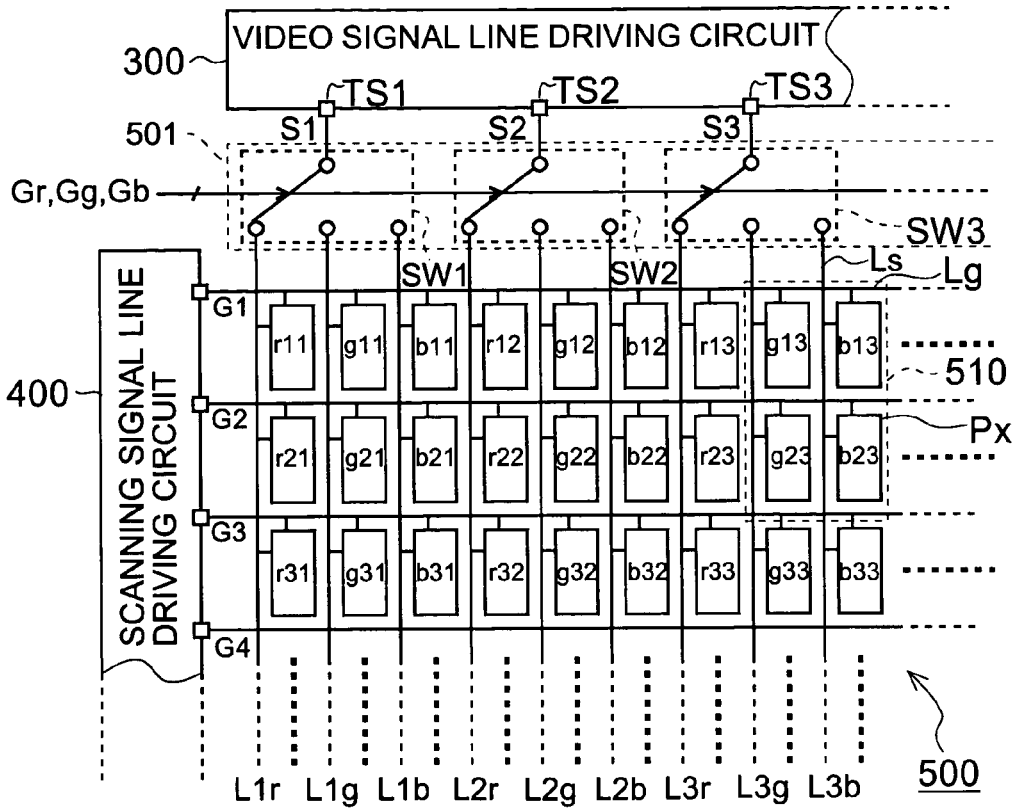
FIG. 2A is a diagrammatic view showing the configuration of a liquid crystal panel in the liquid crystal display device provided with the video signal line driving circuit according to this embodiment.
Figure 2B:
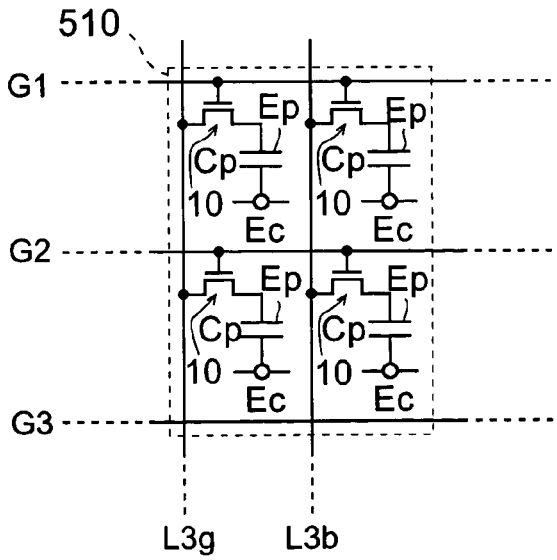
FIG. 2B is an equivalent circuit diagram of a portion of the liquid crystal panel in the liquid crystal display device provided with the video signal line driving circuit according to this embodiment.
Figure 2C:
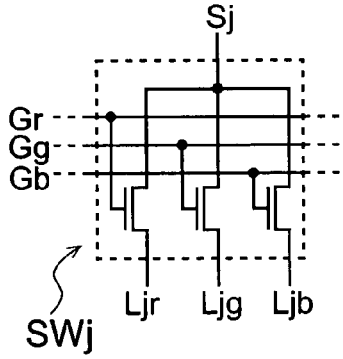
FIG. 2C is an equivalent circuit diagram of one of the selector switches constituting a connection switching circuit of the liquid crystal panel in the liquid crystal display device provided with the video signal line driving circuit according to this embodiment.

FIG. 2A is a diagrammatic view showing the configuration of the liquid crystal panel 500 in the liquid crystal display device provided with the video signal line driving circuit 300 according to the present embodiment. FIG. 2B is an equivalent circuit diagram of a portion 510 (corresponding to four pixels) of this liquid crystal panel 500. FIG. 2C is an equivalent circuit diagram of one of the selector switches SWj constituting a connection switching circuit 501 in this liquid crystal panel 500.

The liquid crystal panel 500 includes a plurality of video signal lines Ls (Ljr, Lig, Ljb (j=1, 2, 3, . . . )) that are connected via the connection switching circuit 501 including the selector switches SW1, SW2, SW3, . . . to the video signal line driving circuit 300, and a plurality of scanning signal lines Lg that are connected to the scanning signal line driving circuit 400. The video signal lines Ls and the scanning signal lines Lg are arranged in a lattice pattern, so that the video signal lines Ls intersect with the scanning signal lines Lg. A plurality of pixel formation portions Px are arranged respectively in correspondence to the intersections of the video signal lines Ls and the scanning signal lines Lg. As shown in FIG. 2B, each of the pixel formation portions Px is made of a TFT 10 whose source terminal is connected to the video signal line Ls passing through the corresponding intersection and whose gate terminal is connected to the scanning signal line Lg passing through the corresponding intersection, a pixel electrode Ep connected to the drain electrode of that TFT 10, a common electrode Ec that is shared by the plurality of pixel formation portions Px, and a liquid crystal layer that is shared by the plurality of pixel formation portions Px and sandwiched between the pixel electrode Ep and the common electrode Ec. The pixel electrode Ep, the common electrode Ec and the liquid crystal layer sandwiched between the pixel electrode Ep and the common electrode Ec form a pixel capacitance Cp.

These pixel formation portions Px are classified by color filters into an R pixel formation portion for forming red pixels, a G pixel formation portion for forming green pixels, and a B pixel formation portion for forming blue pixels. With three pixel formation portions, including an R pixel formation portion, a G pixel formation portion and a B pixel formation portion that are arranged next to one another in the direction in which the scanning signal lines Lg extend, serving as one display unit, the pixel formation portions are arranged in a matrix, forming a pixel formation matrix. The pixel electrodes Ep, which are the principal portions of the pixel formation portions Px, are in a one-to-one correspondence with the pixels of the image displayed on the liquid crystal panel, and can be regarded as identical therewith, so that the "pixel formation matrix" is also referred to as the "pixel matrix."

As noted above, the liquid crystal panel 500 is provided with a connection switching circuit 501 (see FIG. 2A), which comprises selector switches SW1, SW2, SW3, . . . , respectively corresponding to the video signal lines Ls on the liquid crystal panel 500 as a circuit for connecting the video signal lines Ls to the video signal line driving circuit 300. These selector switches SW1, SW2, SW3, . . . respectively correspond to the output terminals TS1, TS2, TS3, . . . of the video signal line driving circuit 300. Moreover, the video signal lines Ls on the liquid crystal panel 500 are grouped into a plurality of video signal line groups, each group including three video signal lines Ljr, Ljg and Ljb for supplying driving video signals respectively to the R pixel formation portion, the G pixel formation portion and the B pixel formation portion constituting the display units, and these video signal line groups are in a one-to-one correspondence with the output terminals TSj (j=1, 2, 3, . . . ) of the video signal line driving circuit 300.

Each of the selector switches SWj (j=1, 2, 3, . . . ) connects the output terminal TSj of the video signal line driving circuit 300 corresponding to that selector switch SWj to one of the three video signal lines Ljr, Ljg and Ljb corresponding to that output terminal TSj, and the video signal lines connected to the output terminal TSj are switched successively between the three video signal lines Ljr, Ljg and Ljb. That is to say, the switching control signals Gr, Gg and Gb from the display control circuit 200 are inputted to the selector switches SWj, and the selector switches SWj connect the output terminals TSj to the R video signal lines Ljr, which are the video signal lines connected to the R pixel formation portions, during a first period, in which the first switching control signal Gr is at H level, of each horizontal scanning period, connect the output terminals TSj to the G video signal lines Ljg, which are the video signal lines connected to the G pixel formation portions, during a second period, in which the second switching control signal Gg is at H level, of each horizontal scanning period, and connect the output terminals TSj to the B video signal lines Ljb, which are the video signal lines connected to the B pixel formation portions, during a third period, in which the third switching control signal Gb is at H level, of each horizontal scanning period. These selector switches SWj are realized by thin-film transistors (TFTs) formed on the liquid crystal panel substrate, for example, and as shown in FIG. 2C, TFTs serving as three analog switches are configured such that they are turned on and off by the first, second and third switching control signals Gr, Gg and Gb respectively. With this connection switching circuit 501 comprising the selector switches SW1, SW2, SW3, . . . , each of the output terminals TSj of the video signal line driving circuit 300 can be connected by time division to the three video signal lines Ljr, Ljg and Ljb in the corresponding video signal line group.

1.4 Signal Line Driving Circuit

Figure 3:
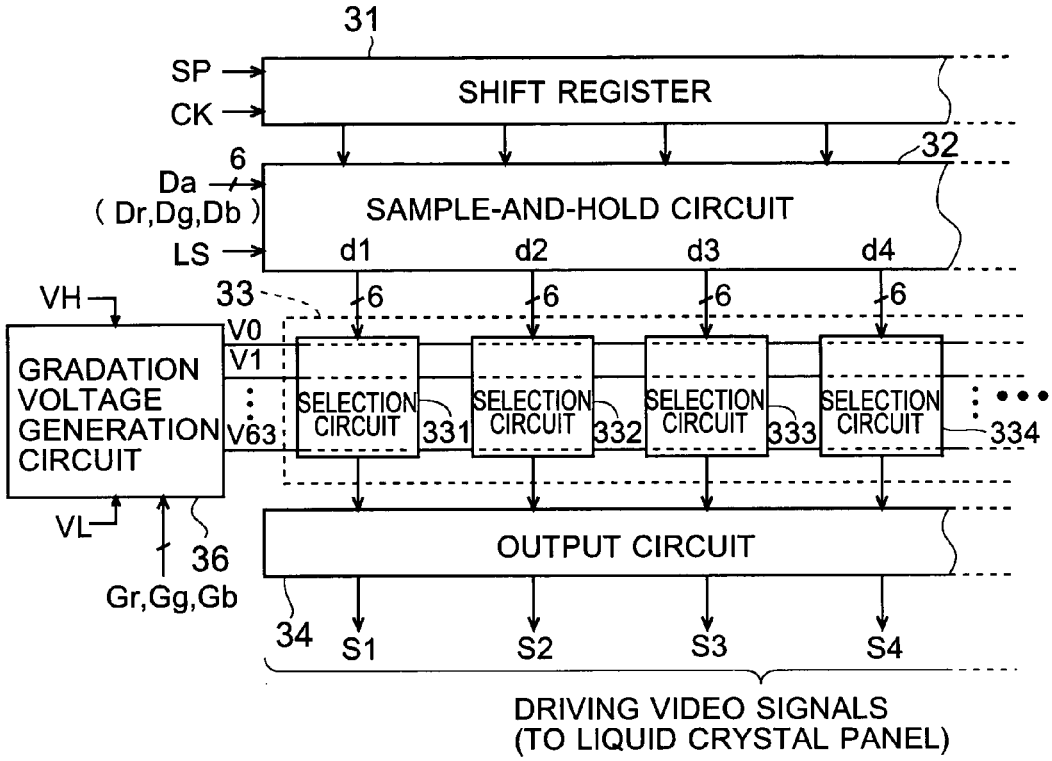
FIG. 3 is a block diagram showing the configuration of the video signal line driving circuit according to this embodiment.

FIG. 3 is a block diagram showing the configuration of the video signal line driving circuit 300 according to the present embodiment. The following is a detailed description of the video signal line driving circuit 300, with reference to FIG. 3. It should be noted that ordinary liquid crystal display devices are AC driven in order to prevent deterioration of the liquid crystal as well as to sustain the display quality, but the configuration and operation for AC driving are not directly related to the present invention, so that further explanation thereof has been omitted.

The video signal line driving circuit 300 according to the present embodiment includes a shift register 31, a sample-and-hold circuit 32, a gradation voltage selection portion 33, an output circuit 34, and a gradation voltage generation circuit 36. The shift register 31 has the same number of stages as there are output terminals TSj (j=1, 2, 3, . . . ). The sample-and-hold circuit 32 outputs digital image signals d1, d2, d3, . . . that are 6-bit signals and respectively correspond to the output terminals TS1, TS2, TS3, . . . The gradation voltage selection portion 33 is made of selection circuits 33*j* corresponding to the output terminals TSj. The output circuit 34 generates the driving video signals Sj that are to be outputted from the output terminals TSj. The gradation voltage generation circuit 36 outputs a gradation voltage group V0 to V63 made of voltages that respectively correspond to the 64 gradation levels.

In the video signal line driving circuit 300 with this configuration, the start pulse signal SP and the clock signal CK are inputted into the shift register 31, which transfers one pulse included in the start pulse signal SP successively from the input terminal to the output terminal in the first, the second and the third period of each horizontal scanning period, based on the signals SP and CK. In correspondence with this transfer, sampling pulses are inputted in order into the sample-and-hold circuit 32.

The sample-and-hold circuit 32 samples and holds the digital image signals Da from the display control circuit 200 at the timings of these sampling pulses, latches them with the latch strobe signal LS, and holds them for ⅓ horizontal scanning period each. The held digital image signals Da are outputted from the sample-and-hold circuit 32 as 6-bit internal image signals d1, d2, d3. These internal image signals d1, d2, d3, . . . are respectively inputted into selection circuits 331, 332, 333, . . . in the gradation voltage selection portion 33. As mentioned above, the digital image signals Da that are inputted from the display control circuit 200 are switched between the red image signal Dr, the green image signal Dg and the blue image signal Db at every ⅓ horizontal scanning period, in synchronization with the switching control signals Gr, Gg and Gb. In accordance with this switching, the values of the internal image signals d1, d2, d3, . . . correspond to the R pixel values represented by the red image signal Dr in the first period, to the G pixel values represented by the green image signal Dg in the second period, and to the B pixel values represented by the blue image signal Db in the third period.

Based on the two reference voltages VH and VL that are applied from a predetermined power source circuit (not shown in the drawings), the gradation voltage generation circuit 36 generates 64 voltages V0 to V63 that respectively correspond to the 64 gradation levels that can be expressed by the 6-bit digital image signals Da, and outputs these voltages as the gradation voltage group V0 to V63. Based on the switching control signals Gr, Gg and Gb, the voltages V0 to V63 constituting this gradation voltage group are varied somewhat in response to the switching of the driving periods of the video signal lines Ls (details are described below). The gradation voltage selection portion 33 is provided with 64 voltage bus lines that pass through all selection circuits 331, 332, 333, . . . , and the 64 voltages constituting the gradation voltage group V0 to V63 are respectively applied to the 64 voltage bus lines and transmitted to each of the selection circuits 331, 332, 333, . . .

Based on the internal image signals dj inputted into the selection circuits 33*j* (j=1, 2, 3, . . . ), each of the selection circuits 33*j* selects one voltage VS (wherein S is an integer of 0=S=63) from the gradation voltage group V0 to V63 transmitted by the 64 voltage bus lines. As noted above, the values of the internal image signals dj correspond to the R pixel values in the first period, to the G pixel values in the second period, and to the B pixel values in the third period of each horizontal scanning period. Consequently, each of the selection circuits 33*j* selects a voltage VS from the gradation voltage group V0 to V63 in accordance with the red image signals Dr indicating the R (red) gradation in the first period, in accordance with the green image signals Dg indicating the G (green) gradation in the second period, and in accordance with the blue image signals Db indicating the B (blue) gradation in the third period. The voltages VS selected by the selection circuits 33*j* in this manner are inputted into the output circuit 34.

The output circuit 34 performs an impedance conversion, for example with a voltage follower, of the voltages inputted from the selection circuits 33*j*, and outputs the converted voltages as the driving video signals Sj from the output terminals TSj. The outputted driving video signals Sj are inputted into the selector switches SWj of the liquid crystal panel as mentioned above, and applied via the selector switches SWj to the video signal lines Ljr, Ljg, or Ljb.

1.5 Driving Method

Referring to FIGS. 2A and 4A to 4K, the following is a description of a method for driving the liquid crystal display device comprising the liquid crystal panel 500 and the video signal line driving circuit 300 configured as described above.

The references "rij," "gij" and "bij" attached to the pixel formation portions Px in FIG. 2A indicate the pixel value (that is, the voltage value to be held by the pixel capacitance Cp) to be written into the pixel formation portion of the i-th row and the j-th column of the pixel formation matrix, "rij" corresponds to the value of the red image signal Dr, "gij" corresponds to the value of the green image signal Dg, and "bij" corresponds to the value of the blue image signal Db. Consequently, the pixel formation portions marked "rij" are R pixel formation portions, the pixel formation portions marked "gij" are G pixel formation portions, and the pixel formation portions marked "bij" are B pixel formation portions.

FIGS. 4A to 4K are timing charts illustrating the method for driving the liquid crystal display device comprising the liquid crystal panel 500 and the video signal line driving circuit 300 with the above configuration. As shown in FIGS. 4A to 4C, scanning signals G1, G2, G3, . . . that are successively at H level for one horizontal scanning period (one scanning line selection period) each are applied to the scanning signal lines Lg of the liquid crystal panel 500. When an H level is applied by these scanning signals G1, G2, G3, . . . , the scanning signal lines Lg take on a selected (active) state, and the TFTs 10 of the pixel formation portions Px connected to the selected scanning signal lines Lg are turned on. On the other hand, when an L level is applied, the scanning signal lines Lg take on a non-selected (inactive) state, and the TFTs 10 of the pixel formation portions Px connected to the non-selected scanning signal lines Lg are turned off.

As shown in FIG. 4E, the first switching control signal Gr is at H level in the first period, which is the first ⅓ of each horizontal scanning period (i.e. the period in which any of the horizontal scanning signals Gi (i=1, 2, 3, . . . ) is at H level), and in this first period, the voltage signal (rij), which corresponds to the red image signal Dr, is outputted from the output terminals Tsj of the video signal line driving circuit as the driving video signal Sj (j=1, 2, 3, . . . ), as shown in FIGS. 4H to 4J. As shown in FIG. 4F, the second switching control signal Gg is at H level in the second period, which is the second ⅓ of each horizontal scanning period, and in this second period, the voltage signal (gij), which corresponds to the green image signal Dg, is outputted from the output terminals Tsj of the video signal line driving circuit as the driving video signal Sj, as shown in FIGS. 4H to 4J. As shown in FIG. 4G, the third switching control signal Gb is at H level in the third period, which is the last ⅓ of each horizontal scanning period, and in this third period, the voltage signal (bij), which corresponds to the blue image signal Db, is outputted from the output terminals Tsj of the video signal line driving circuit as the driving video signal Sj, as shown in FIGS. 4H to 4J.

As mentioned above, each of the selector switches SWj (j=1, 2, 3, . . . ) connect the corresponding output terminal TSj of the video signal line driving circuit to the R video signal line Ljr in the first period, to the G video signal line Ljg in the second period, and to the B video signal line Ljb in the third period of the horizontal scanning period. Thus, the video signal lines Ls (Ljr, Ljg, and Ljb) of the liquid crystal panel 500 are driven by time division.

Figure 9:
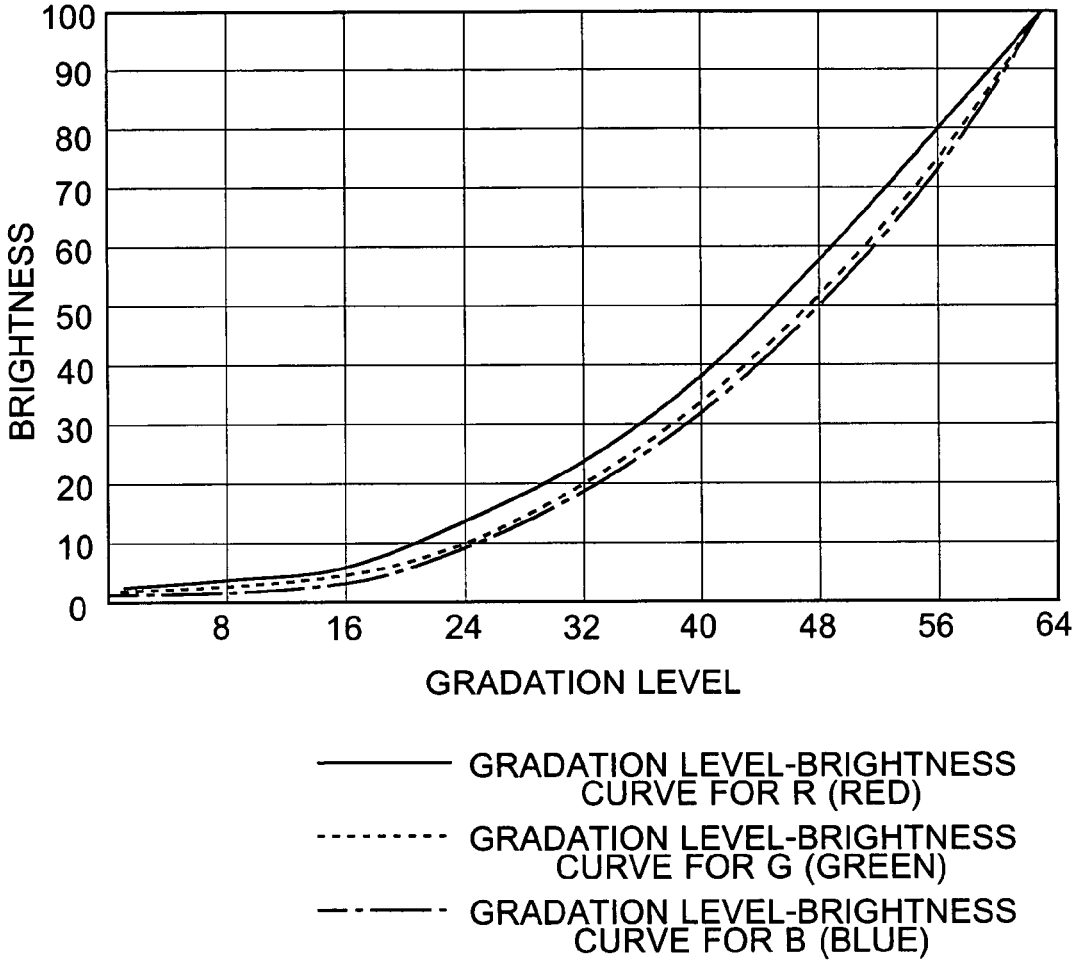
FIG. 9 is a characteristic graph showing the gradation level—brightness curve for the three primary colors (R, G and B) respectively.

On the other hand, the gradation voltage generation circuit 36 changes the voltages V0 to V63 constituting the gradation voltage group in accordance with the first, second and third switching control signals Gr, Gg and Gb. As shown in FIG. 9, the gradation level—brightness curve (gradation reproducibility) differs somewhat for the three colors R (red), G (green) and B (blue), so that if the voltages V0 to V63 constituting the gradation voltage group are fixed values as in the related art, then a favorable color balance cannot be maintained across the entire brightness range, and a high degree of color reproducibility cannot be attained for the color image display. Addressing this problem, in the present embodiment, the voltages V0 to V63 of the gradation voltage group are switched for the first, the second and the third period in accordance with the differences of the respective gradation reproducibilities of the three colors, and thus the same brightness is attained for the same gradation level (i.e. the same value of the image signals Dr, Dg and Db), regardless whether the pixel formation portion is an R pixel formation portion, a G pixel formation portion or a B pixel formation portion. That is to say, three gradation voltage groups V0r to V63*r*, V0*g* to V63*g* and V0*b* to V63*b* are set in advance for R, G and B, respectively, and as shown in FIG. 4K, the gradation voltage generation circuit 36 is configured (as described in more detail below) such that the gradation voltage group V0*r* to V63*r* adapted to the gradation reproducibility at the R pixel formation portions is outputted as the gradation voltage group V0 to V63 in the first period of each horizontal scanning period, the gradation voltage group V0*g* to V63*g* adapted to the gradation reproducibility at the G pixel formation portions is outputted as the gradation voltage group V0 to V63 in the second period of each horizontal scanning period, and the gradation voltage group V0*b* to V63*b* adapted to the gradation reproducibility at the B pixel formation portions is outputted as the gradation voltage group V0 to V63 in the third period of each horizontal scanning period, With this operation of the various portions, the voltages selected at each output terminal TSj in accordance with the red image signal Dr from the gradation voltage group V0*r* to V63*r* set for R (red) are outputted as the driving video signals Sj, and supplied via the selector switches SWj and the R video signal lines Ljr of the liquid crystal panel 500 to the R pixel formation portions in the first period of each horizontal scanning period. Similarly, the voltages selected at each output terminal TSj in accordance with the green image signal Dg from the gradation voltage group V0*g* to V63*g* set for G (green) are outputted as the driving video signals Sj, and supplied via the selector switches SWj and the G video signal lines Ljg to the G pixel formation portions in the second period of each horizontal scanning period. And the voltages selected at each output terminal TSj in accordance with the blue image signal Db from the gradation voltage group V0*b* to V63*b* set for B (blue) are outputted as the driving video signals Sj, and supplied via the selector switches SWj and the B video signal lines Ljb to the B pixel formation portions in the third period of each horizontal scanning period. Thus, voltages selected from the gradation voltage groups that differ for R pixel formation portions, G pixel formation portions and B pixel formation portions are supplied to the pixel formation portions as the driving video signals, so that a color image display with a high degree of color reproducibility is possible with the liquid crystal panel.

1.6 Configuration of Gradation Voltage Generation Circuit

The following is a description of configurations of the gradation voltage generation circuit 36 according to the present embodiment.

1.6.1 First Configuration Example

Figure 5:
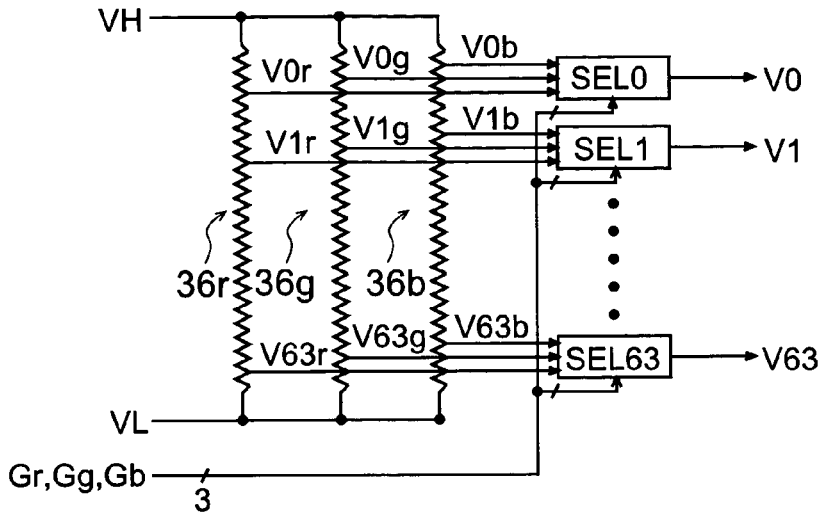
FIG. 5 is a circuit diagram showing a first configuration example of the gradation voltage generation circuit in this embodiment.

FIG. 5 is a circuit diagram showing a first configuration example of the gradation voltage generation circuit 36 of the present embodiment. In this configuration example, the gradation voltage generation circuit 36 includes first, second and third voltage divider circuits 36*r*, 36*g* and 36*b*, and a selector circuit made of 64 selectors SEL0 to SEL63. A first reference voltage VH is applied from the outside to one side of each of the voltage divider circuits 36*r*, 36*g* and 36*b* and a second reference voltage VL is applied from the outside to the other side of each of the voltage divider circuits 36*r*, 36*g* and 36*b*. The voltage divider circuits 36*r*, 36*g* and 36*b* are made of resistor series, in which a plurality of resistors have been connected in series. The first voltage divider circuit 36*r* generates a preset gradation voltage group V0*r* to V63*r* for R (red), the second voltage divider circuit 36*g* generates a preset gradation voltage group V0*g* to V63*g* for G (green), and the third voltage divider circuit 36*b* generates a preset gradation voltage group V0*b* to V63*b* for B (blue). Three voltages Vkr, Vkg and Vkb corresponding to the same gradation level in the three gradation voltage groups V0*r* to V63*r*, V0*g* to V63*g* and V0*b* to V63*b* and the switching control signals Gr, Gg and G are inputted into the selectors SELk (k=0 to 63), and the selectors SELk respectively select Vkr when the first switching control signal Gr is at H level, Vkg when the second switching control signal Gg is at H level, and Vkb when the third switching control signal Gb is at H level. Thus, the. 64 voltages selected by the 64 selectors SEL0 to SEL63 are outputted from the gradation voltage generation circuit 36 as the gradation voltage group V0 to V63, and are respectively applied to the 64 voltage bus lines passing through the selection circuits 331, 332, 333, . . .

With this configuration, the voltages constituting the outputted gradation voltage group V0 to V63 are switched in response to the switching between the first period, the second period and the third period, based on the switching control signals Gr, Gg and Gb, that is, the switching of the driving period. Thus, as shown in FIG. 4K, in the first period in which the R video signal lines Ljr are driven, the gradation voltage group V0*r* to V63*r* adapted to the gradation reproducibility of the R pixel formation portions is outputted, in the second period in which the G video signal lines Ljg are driven, the gradation voltage group V0*g* to V63*g* adapted to the gradation reproducibility of the G pixel formation portions is outputted, and in the third period in which the B video signal lines Ljb are driven, the gradation voltage group V0*b* to V63*b* adapted to the gradation reproducibility of the B pixel formation portions is outputted.

1.6.2 Second Configuration Example

Figure 6:
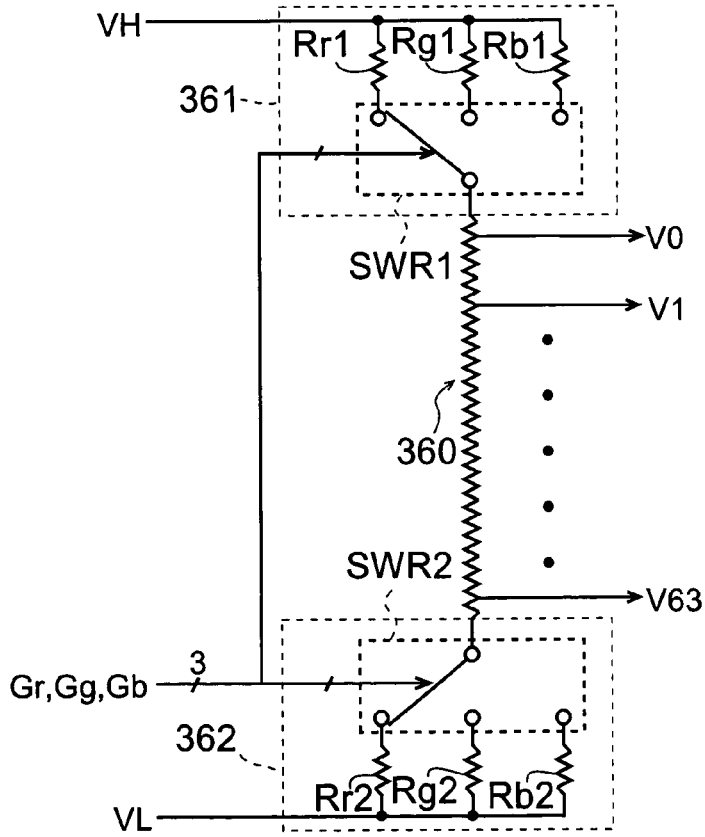
FIG. 6 is a circuit diagram showing a second configuration example of the gradation voltage generation circuit in this embodiment.

FIG. 6 is a circuit diagram showing a second configuration of the gradation voltage generation circuit 36 according to the present embodiment. In this configuration example, the gradation voltage generation circuit 36 includes one voltage divider circuit 360, a first variable resistor circuit 361, and a second variable resistor circuit 362. The voltage divider circuit 360 is made of a resistor series in which a plurality of resistors are connected in series, in order to generate a gradation voltage group V0 to V63 made of 64 voltages. The first variable resistor circuit 361 is connected to one side of this voltage divider circuit 360, and the second variable resistor circuit 362 is connected to the other side of this voltage divider circuit 360.

The first variable resistor circuit 361 is made of a first R adjustment resistor Rr1, which is a resistor having a predetermined resistance for R (red), a first G adjustment resistor Rg1, which is a resistor having a predetermined resistance for G (green), a first B adjustment resistor Rb1, which is a resistor having a predetermined resistance for B (blue), and a first adjustment resistor selector switch SWR1. One side of the first R, G and B adjustment resistors Rr1, Rg1 and Rb1 is connected to a power source line of a first reference voltage VH, and the other side is connected to the first adjustment resistor selector switch SWR1. The first adjustment resistor selector switch SWR1 connects one side of the voltage divider circuit 360 to the first R adjustment resistor Rr1, G adjustment resistor Rg1 or B adjustment resistor Rb1, and switches the resistor connected to the voltage divider circuit 360 in accordance with the switching control signal Gr, Gg and Gb. That is to say, the first R adjustment resistor Rr1 is connected to the one side of the voltage divider circuit 360 during the first period, the first G adjustment resistor Rg1 is connected to the one side of the voltage divider circuit 360 during the second period, and the first B adjustment resistor Rb1 is connected to the one side of the voltage divider circuit 360 during the third period of each horizontal scanning period.

The second variable resistor circuit 362 is made of a second R adjustment resistor Rr2, which is a resistor having a predetermined resistance for R (red), a second G adjustment resistor Rg2, which is a resistor having a predetermined resistance for G (green), a second B adjustment resistor Rb2, which is a resistor having a predetermined resistance for B (blue), and a second adjustment resistor selector switch SWR2. One side of the second R, G and B adjustment resistors Rr2, Rg2 and Rb2 is connected to a power source line of a second reference voltage VL, and the other side is connected to the second adjustment resistor selector switch SWR2. The second adjustment resistor selector switch SWR2 connects the other side of the voltage divider circuit 360 to the second R adjustment resistor Rr2, G adjustment resistor Rg2 or B adjustment resistor Rb2, and switches the resistor connected to the other side of the voltage divider circuit 360 in accordance with the switching control signal Gr, Gg and Gb. That is to say, the second R adjustment resistor Rr2 is connected to the other side of the voltage divider circuit 360 during the first period, the second G adjustment resistor Rg2 is connected to the other side of the voltage divider circuit 360 during the second period, and the second B adjustment resistor Rb2 is connected to the other side of the voltage divider circuit 360 during the third period of each horizontal scanning period.

With this configuration, in response to the switching between the first period, the second period and the third period, based on the switching control signals Gr, Gg and Gb, the resistance between the two terminals of the first variable resistor circuit 361 is switched between the resistances of the first R, G and B adjustment resistors Rr1, Rg1 and Rb1, and the resistance between the two terminals of the second variable resistor circuit 362 is switched between the resistances of the second R, G and B adjustment resistors Rr2, Rg2 and Rb2. Consequently, by appropriately setting the resistances of the first R, G and B adjustment resistors Rr1, Rg1 and Rb1 and the resistances of the second R, G and B adjustment resistors Rr2, Rg2 and Rb2, in the first period, in which the R video signal lines Ljr are driven, the 64 voltages V0*r* to V63*r* adapted to the gradation reproducibility of the R pixel formation portions are outputted as the gradation voltage group V0 to V63, in the second period, in which the G video signal lines Ljg are driven, the 64 voltages V0*g* to V63*g* adapted to the gradation reproducibility of the G pixel formation portions are outputted as the gradation voltage group V0 to V63, and in the third period, in which the B video signal lines Ljb are driven, the 64 voltages V0*b* to V63*b* adapted to the gradation reproducibility of the B pixel formation portions are outputted as the gradation voltage group V0 to V63. Moreover, in this configuration example, there is only one voltage divider circuit, so that compared to the first configuration example shown in FIG. 5, the scale of the gradation voltage generation circuit can be made smaller.

It should be noted that the first and the second variable resistor circuits 361 and 362 in this configuration example are not limited to the configuration shown in FIG. 6, and other configurations are possible in which the first and the second variable resistor circuits 361 and 362 operate as variable resistors whose resistance is switched in accordance with the switching control signals Gr, Gg and Gb.

1.6.3 Other Configuration Examples

Figure 7:
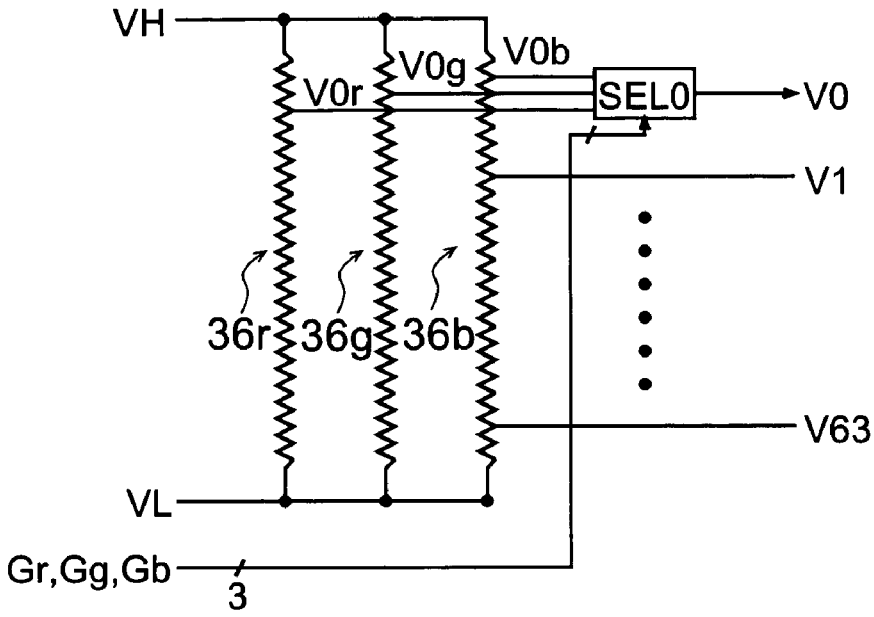
FIG. 7 is a circuit diagram showing another configuration example of the gradation voltage generation circuit in this embodiment.

In the first and second configuration examples, the voltages V0 to V63 constituting the outputted gradation voltage group are changed depending on whether it is the first period, the second period or the third period, based on the switching control signals Gr, Gg and Gb, but it is also possible to change only one or some of the voltages V0 to V63 constituting the outputted gradation voltage group based on the switching control signals Gr, Gg and Gb. For example, as shown in FIG. 7, it is possible that, of the voltages V0 to V63 constituting the gradation voltage group to be outputted from the gradation voltage generation circuit 36, only the voltage V0, which corresponds to one gradation level, is switched between the three voltages V0*r*, V0*g* and V0*b* at the selector SEL0, based on the switching control signals Gr, Gg and Gb.

Figure 8:
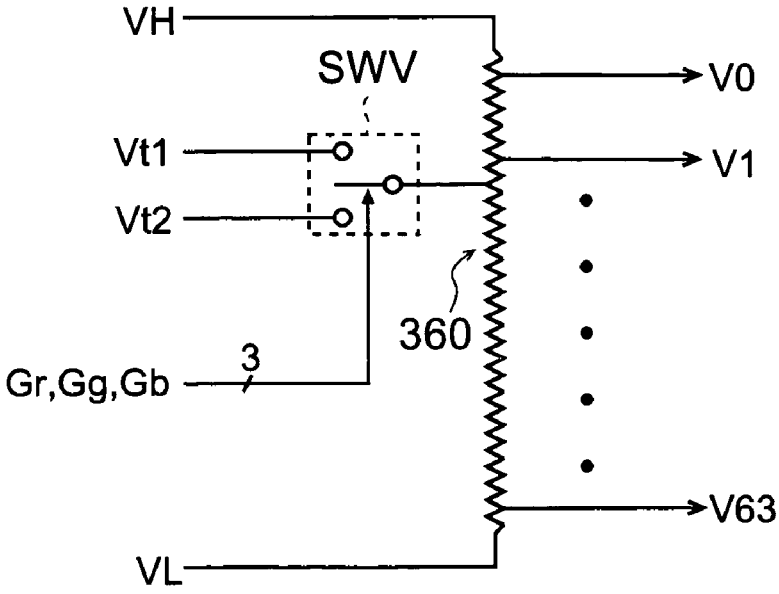
FIG. 8 is a circuit diagram showing yet another configuration example of the gradation voltage generation circuit in this embodiment.

Moreover, in the first and second configuration example, the voltages V0 to V63 constituting the gradation voltage group to be outputted are changed in accordance with the switching control signals Gr, Gg and Gb by switching resistors or resistor series (voltage divider circuits) that are used to generate the voltages V0 to V63, but instead of or in addition to this configuration, it is also possible to change the voltages V0 to V63 constituting the gradation voltage group to be outputted from the gradation voltage generation circuit 36 by providing a circuit for applying a predetermined voltage from the outside to a predetermined position in the voltage divider circuits, and controlling this voltage application with the switching control signals Gr, Gg and Gb. For example, as shown in FIG. 8, a voltage selector switch SWV may be provided, to which two voltages Vt1 and Vt2 are supplied from the outside, and the voltage selector switch SWV may be connected to a predetermined position of the voltage divider circuit 360. This voltage selector switch SWV is configured such that, based on the switching control signals Gr, Gg, and Gb, the respective power source lines of voltages Vt1 and Vt2 are connected to the predetermined position of the voltage divider circuit 360 such that the voltage Vt1 is applied to the predetermined position of the voltage divider circuit 360 during the first period, the voltage Vt2 is applied during the third period, and neither of the voltages Vt1 and Vt2 are applied during the second period of the horizontal scanning period. Moreover, the gradation voltage generation circuit 36 may also be realized as a circuit combining a configuration for controlling the voltage application to the predetermined position of the voltage divider circuit and a configuration for switching resistors or resistor series as in the first or second configuration example.

Moreover, the configuration of the gradation voltage generation circuit 36 is not limited to the configuration examples shown in FIGS. 5 to 8 and is not limited to the combinations thereof, and the gradation voltage generation circuit 36 may also be configured such that all or a portion of the voltages V0 to V63 constituting the gradation voltage group to be outputted are changed in accordance with the switching control signals Gr, Gg and Gb, such that a gradation voltage group is outputted that is adapted to the first period, in which the R video signal lines Ljr are driven, the second period, in which the G video signal lines Ljg are driven, and the third period, in which the B video signal lines Ljb are driven. The specific configuration can be selected in consideration of such factors, for example, as the degree of freedom to change the voltages constituting the gradation voltage group to be outputted and the circuit scale of the gradation voltage generation circuit.

1.7 Advantageous Effect

With the present embodiment as described above, the video signal lines are driven by time division, based on the switching control signals Gr, Gg and Gb, so that each horizontal scanning period is divided into a first period in which the R video signal lines Ljr are driven and the pixel values are written into the R pixel formation portions, a second period in which the G video signal lines Ljg are driven and the pixel values are written into the G pixel formation portions, and a third period in which the B video signal lines Ljb are driven and the pixel values are written into the B pixel formation portions. Taking advantage of this, a gradation voltage group corresponding to the respective gradation reproducibility of the R pixel formation portions, the G pixel formation portions and the B pixel formation portions is supplied to each of the selection circuits 33*j* (j=1, 2, 3, . . . ) without increasing the number of voltage bus lines for transmitting the gradation voltage group, by changing the voltages V0 to V63 (or at least a portion thereof) constituting the gradation voltage group outputted from the gradation voltage generation circuit 36, based on the switching control signals Gr, Gg, and Gb, and the driving video signals Sj are generated using this gradation voltage group. Thus, the liquid crystal panel 500 displays a color image based on a gradation voltage group that has been corrected in accordance with the differences in gradation reproducibility of the three colors R, G and B. Consequently, color image display with a high degree of color reproducibility becomes possible, while avoiding an increase in the chip surface area of the IC for the video signal line driving circuit, due to the providing of voltage bus lines for transmitting the gradation voltage group in the present embodiment.

2. Other Embodiments and Modification Examples

In the foregoing embodiment, each horizontal scanning period is divided into a first, a second and a third period, and the R video signal lines Ljr connected to the R pixel formation portions, the G video signal lines Ljg connected to the G pixel formation portions and the B video signal lines Ljb connected to the B pixel formation portions of the liquid crystal panel 500 are driven by time division, based on the switching control signals Gr, Gg and Gb. However, the present invention is not limited to such display device driving circuits, and the present invention can also be applied to display device driving circuits which are for displaying color images based on three image signals representing the gradations of a first, a second and a third color constituting three primary colors, and which output driving signals subjected to time division based on these three image signals, that is, driving circuits that divide a driving period into a period in which driving signals based on image signals representing the gradation of a first color are outputted, a period in which driving signals based on image signals representing the gradation of a second color are outputted, and a period in which driving signals based on image signals representing the gradation of a third color are outputted. For example, the present invention can also be applied to driving circuits of liquid crystal display devices based on sequential color illumination, that is, liquid crystal display devices in which each frame is divided into three sub-frame periods, namely an R sub-frame, a G sub-frame and a B sub-frame, and the driving signal based on the image signal representing the gradation of red is outputted in the R sub-frame, the driving signal based on the image signal representing the gradation of green is outputted in the G sub-frame, and the driving signal based on the image signal representing the gradation of blue is outputted in the B sub-frame. In this case, similar effects as with the foregoing embodiment can be attained if a portion or all of the voltages constituting the gradation voltage group are changed in accordance with the gradation reproducibility of R (red) in the R sub-frame, changed in accordance with the gradation reproducibility of G (green) in the G sub-frame, and changed in accordance with the gradation reproducibility of B (blue) in the B sub-frame.

It should be noted that in the foregoing embodiment, the connection switching circuit 501 made of the selector switches SWj (j=1, 2, . . . ) for time division driving of the video signal lines is formed within the liquid crystal panel 500, but instead, for example, it is also possible to provide a connection switching circuit 501 made of the selector switches SWj (j=1, 2, . . . ) within an IC chip realizing the video signal line driving circuit 300.

Moreover, in the foregoing embodiment, the three primary colors for color image display were assumed to be red (R), green (G) and blue (B), but it is also possible to chose three other primary colors, as long as they are three primary colors with which the necessary color range for color image display can be attained.

While the invention has been described in detail, the foregoing description is in all aspects illustrative and not restrictive. It is understood that numerous other modifications and variations can be devised without departing from the scope of the invention.

What is claimed is:

1. A color image display driving circuit for generating a plurality of voltage signals to be applied to a plurality of pixel formation portions, based on input signals including a first, a second and a third color image signal that respectively represent gradations of a first, a second and a third color constituting three primary colors, the driving circuit comprising:

a gradation voltage generation circuit for outputting a gradation voltage group made of a plurality of voltages that represent different gradations, said gradation voltage generation circuit comprising a voltage divider circuit for generating a plurality of voltages, a first variable resistor circuit connected to one side of the voltage divider circuit, and a second variable resistor circuit connected to the other side of the voltage divider circuit;

a plurality of selection circuits, each selection circuit being for selecting one of the plurality of voltages in the gradation voltage group in accordance with the input signals; and an output circuit for outputting the plurality of voltages selected by the plurality of selection circuits respectively as the plurality of voltage signals;

wherein the plurality of selection circuits successively switch between a first period in which the voltage is selected in accordance with the first color image signal, a second period in which the voltage is selected in accordance with the second color image signal, and a third period in which the voltage is selected in accordance with the third color image signal;

wherein the first variable resistor circuit comprises a first selector for switching the resistance of the first variable resistor circuit such that the resistance of the first variable resistor circuit takes on a preset first value corresponding to the first color in the first period, a preset second value corresponding to the second color in the second period, and a preset third value corresponding to the third color in the third period;

wherein the second variable resistor circuit comprises a second selector switch for switching the resistance of the second variable resistor circuit such that the resistance of the second variable resistor circuit takes on a preset fourth value corresponding to the first color in the first period, a preset fifth value corresponding to the second color in the second period, and a preset sixth value corresponding to the third color in the third period; and wherein the gradation voltage generation circuit outputs the plurality of voltages generated by the voltage divider circuit as the gradation voltage group and changes a portion of or all voltages constituting the gradation voltage group in response to the switching between the first period, the second period and the third period, and in accordance with the differences between the first color, the second color and the third color in gradation reproducibility of the plurality of pixel formation portions.

2. The driving circuit according to claim 1, wherein the gradation voltage generation circuit comprises:

a first voltage divider circuit for generating a plurality of voltages representing the different gradations of the first color;

a second voltage divider circuit for generating a plurality of voltages representing the different gradations of the second color;

a third voltage divider circuit for generating a plurality of voltages representing the different gradations of the third color; and a selector circuit for selecting the plurality of voltages generated by the first voltage divider circuit in the first period, the plurality of voltages generated by the second voltage divider circuit in the second period, and the plurality of voltages generated by the third voltage divider circuit in the third period;

wherein the plurality of voltages selected by the selector circuit are outputted as the gradation voltage group.

3. A display device comprising:

a color image display driving circuit for generating a plurality of voltage signals to be applied to a plurality of pixel formation portions, based on input signals including a first, a second and a third color image signal that respectively represent gradations of a first, a second and a third color constituting three primary colors;

a gradation voltage generation circuit for outputting a gradation voltage group made of a plurality of voltages that represent different gradations, said gradation voltage generation circuit comprising a voltage divider circuit for generating a plurality voltages, a first variable resistor circuit connected to one side of the voltage divider circuit, and a second variable resistor circuit connected to the other side of the voltage divider circuit;

a plurality of selection circuits, each selection circuit being for selecting one of the plurality of voltages in the gradation voltage group in accordance with the input signals; and an output circuit for outputting the plurality of voltages selected by the plurality of selection circuits respectively as the plurality of voltage signals;

wherein the plurality of selection circuits successively switch between a first period in which the voltage is selected in accordance with the first color image signal, a second period in which the voltage is selected in accordance with the second color image signal, and a third period in which the voltage is selected in accordance with the third color image signal;

wherein the first variable resistor circuit comprises a first selector switch for switching the resistance of the first variable resistor circuit such that the resistance of the first variable resistor circuit takes on a preset first value corresponding to the first color in the first period, a preset second value corresponding to the second color in the second period, and a preset third value corresponding to the third color in the third period;

wherein the second variable resistor circuit comprises a second selector switch for switching the resistance of the second variable resistor circuit such that the resistance of the second variable resistor circuit takes on a preset fourth value corresponding to the first color in the first period, a preset fifth value corresponding to the second color in the second period, and a preset sixth value corresponding to the third color in the third period; and wherein the gradation voltage generation circuit outputs the plurality of voltages generated by the voltage divider circuit as the gradation voltage group and changes a portion of or all voltages constituting the gradation voltage group in response to the switching between the first period, the second period and the third period, and in accordance with the differences between the first color, the second color and the third color in gradation reproducibility of the plurality of pixel formation portions.

4. The display device according to claim 3, wherein the gradation voltage generation circuit comprises:

a first voltage divider circuit for generating a plurality of voltages representing the different gradations of the first color;

a second voltage divider circuit for generating a plurality of voltages representing the different gradations of the second color;

a third voltage divider circuit for generating a plurality of voltages representing the different gradations of the third color; and a selector circuit for selecting the plurality of voltages generated by the first voltage divider circuit in the first period, the plurality of voltages generated by the second voltage divider circuit in the second period, and the plurality of voltages generated by the third voltage divider circuit in the third period;

wherein the plurality of voltages selected by the selector circuit are outputted as the gradation voltage group.

5. The display device according to claim 3, further comprising:

a plurality of video signal lines for transmitting the plurality of voltage signals to the plurality of pixel formation portions; and a connection switching circuit for connecting the output circuit and the plurality of video signal lines such that each of the plurality of voltage signals is applied to one of the plurality of video signal lines, and for switching the video signal lines to which the voltage signals are applied within predetermined video signal line groups;

wherein the output circuit comprises a plurality of output terminals respectively corresponding to a plurality of video signal lines groups obtained by grouping the plurality of video signal lines into a plurality of groups of three video signal lines made of video signal lines for a first, a second and a third color for respectively transmitting voltage signals to the pixel formation portions of a first, second and third color in the plurality of pixel formation portions; and wherein the connection switching circuit connects each output terminal of the output circuit to the video signal line for the first color of the three corresponding video signal lines in the first period, connects each output terminal of the output circuit to the video signal line for the second color of the three corresponding video signal lines in the second period, and connects each output terminal of the output circuit to the video signal line for the third color of the three corresponding video signal lines in the third period.

6. The display device according to claim 5, further comprising:

a plurality of scanning signal lines intersecting with the plurality of video signal lines; and a scanning signal line driving circuit for selectively driving the plurality of scanning signal lines;

wherein the plurality of pixel formation portions are arranged in a matrix, in correspondence with the intersections between the plurality of video signal lines and the plurality of scanning signal lines;

wherein each of the pixel formation portions comprises:

a switching element that is turned on and off by a scanning signal line passing through the corresponding intersection;

a pixel electrode that is connected via the switching element to the video signal line passing through the corresponding intersection; and a common electrode that is shared by the plurality of pixel formation portions, and that is arranged such that a predetermined capacitance is formed between that common electrode and the pixel electrode;

wherein the plurality of selection circuits switch between the first period, the second period and the third period, such that a period from a time at which one scanning signal line is selected by the scanning signal line driving circuit to a time when the next scanning signal line is selected is divided into the first, the second and the third period.

7. A color image display driving method generating a plurality of voltage signals to be applied to a plurality of pixel formation portions, based on input signals including a first, a second and a third color image signal that respectively represent gradations of a first, a second and a third color constituting three primary colors, the driving method comprising:

a gradation voltage generation step of outputting a gradation voltage group made of a plurality of voltages that represent different gradations, wherein the gradation voltage generation step comprises: (a) a first switching step of switching a resistance of a first variable resistor connected to one side of a voltage divider circuit; and (b) a second switching step of switching a resistance of a second variable resistor connected to the other side of the voltage divider circuit; wherein, in the first switching step, the resistance of the first variable resistor is switched such that the resistance of the first variable resistor takes on a preset first value corresponding to the first color in the first period, a preset second value corresponding to the second color in the second period, and a preset third value corresponding to the third color in the third period; and wherein, in the second switching step, the resistance of the second variable resistor is switched such that the resistance of the second variable resistor takes on a preset fourth value corresponding to the first color in the first period, a preset fifth value corresponding to the second color in the second period, and a preset sixth value corresponding to the third color in the third period;

selection steps of selecting one of the plurality of voltages in the gradation voltage group in accordance with the input signals; and an output step of outputting the plurality of voltages selected by executing the selection steps in parallel as the plurality of voltage signals;

wherein, in the selection steps, successive switches are made between a first period in which the voltage is selected in accordance with the first color image signal, a second period in which the voltage is selected in accordance with the second color image signal, and a third period in which the voltage is selected in accordance with the third color image signal; and wherein, in the gradation voltage generation step, the plurality of voltages generated by the voltage divider circuit are outputted as the gradation voltage group and a portion of or all voltages constituting the gradation voltage group is/are changed in response to the switching between the first period, the second period and the third period, and in accordance with the differences between the first color, the second color and the third color in gradation reproducibility of the plurality of pixel formation portions.

8. The driving method according to claim 7, wherein the gradation voltage generation step comprises:

a first voltage dividing step of generating a plurality of voltages representing the different gradations of the first color;

a second voltage dividing step of generating a plurality of voltages representing the different gradations of the second color;

a third voltage dividing step of generating a plurality of voltages representing the different gradations of the third color; and a selecting step of selecting the plurality of voltages generated by the first voltage dividing step in the first period, the plurality of voltages generated by the second voltage dividing step in the second period, and the plurality of voltages generated by the third voltage dividing step in the third period;

wherein, in the gradation voltage generation step, the plurality of voltages selected by the selecting step are outputted as the gradation voltage group.

* * * * *